US007071822B2

(12) United States Patent
Ando et al.

(10) Patent No.: US 7,071,822 B2
(45) Date of Patent: Jul. 4, 2006

(54) MONITORING METHOD, MONITORING SYSTEM, MONITORING PROGRAM, AND RECORD MEDIUM RECORDING THE MONITORING PROGRAM

(75) Inventors: Tanichi Ando, Kawasaki (JP); Atsushi Shimizu, Moko (JP); Yasuhiro Yamaguchi, Kyoto (JP); Hiroya Ueda, Kyoto (JP)

(73) Assignee: OMRON Corporation, Kyoto (JP)

( * ) Notice: Subject to any disclaimer, the term of this patent is extended or adjusted under 35 U.S.C. 154(b) by 92 days.

(21) Appl. No.: 10/434,353

(22) Filed: May 9, 2003

(65) Prior Publication Data

US 2004/0004546 A1 Jan. 8, 2004

(30) Foreign Application Priority Data

May 13, 2002 (JP) ..... 2002-137818

(51) Int. Cl.
*G08B 13/08* (2006.01)

(52) U.S. Cl. ..... 340/545.1; 340/541; 340/550

(58) Field of Classification Search ..... 340/541, 340/542, 545.1, 550, 521; 109/6, 7, 68; 49/30, 49/31, 68

See application file for complete search history.

(56) References Cited

U.S. PATENT DOCUMENTS

| | | | | |
|---|---|---|---|---|
| 4,360,801 | A * | 11/1982 | Duhame | 340/521 |
| 5,694,867 | A * | 12/1997 | Diaz-Lopez | 109/6 |
| 5,955,947 | A * | 9/1999 | Sutsos et al. | 340/5.21 |

FOREIGN PATENT DOCUMENTS

| | | |
|---|---|---|
| DE | 199 38 282 A1 | 2/2001 |
| JP | 07-293071 | 11/1995 |
| JP | 10-055496 | 2/1998 |
| JP | 11-313901 | 11/1999 |
| JP | 2000-182174 | 6/2000 |
| JP | 2000-235688 | 8/2000 |
| JP | 2001-283357 | 12/2001 |
| JP | 2002-041688 | 2/2002 |
| WO | WO 01/03094 A1 | 1/2001 |

* cited by examiner

*Primary Examiner*—Anh V. La
(74) *Attorney, Agent, or Firm*—Foley & Lardner LLP

(57) ABSTRACT

When an anomaly occurs in a monitor area, careless entry of the user into the monitor area is blocked reliably and simply. In a monitoring system for monitoring a house as a monitor area, sensors are placed at appropriate points in the house, and a door open hindrance unit for hindering opening of a front door placed at the entrance of the house is placed. Upon detection of an anomaly in the house based on a detection signal from each sensor, a management unit instructs the door open hindrance unit to hinder opening of the front door.

12 Claims, 9 Drawing Sheets

MONITORING METHOD, MONITORING SYSTEM, MONITORING PROGRAM, AND RECORD MEDIUM RECORDING THE MONITORING PROGRAM

BACKGROUND OF THE INVENTION

1. Field of the Invention

This invention relates to a monitoring method, a monitoring system, and a monitoring program for monitoring one monitor area, and a record medium recording the monitoring program and more particularly to a monitoring system, where, when an anomaly occurs in a monitor area, for simply blocking careless entry of the user of the monitoring system into the monitor area to prevent the user from being injured.

2. Description of Related Arts

Monitoring systems for monitoring one monitor area and detecting an anomaly of an occurrence of a fire in the monitor area, a suspicious person breaking into the monitor area, etc., are known. When detecting the anomaly, the monitoring system reports the anomaly to a monitoring server of the security company of the provider of the monitoring system. The monitoring server informs a firehouse, a police station, etc., of the anomaly. Accordingly, if the user does not exist in the monitor area, a guard of the security company, a fireman, a policeman, etc., can rush to the monitor area and deal speedily with the anomaly.

In such a monitoring system, however, if the user arrives at the monitor area before a guard, a fireman, a policeman, etc., rushes to the monitor area, there is concern that the user will enter the monitor area without being aware of the anomaly in the monitor area and will suffer some injury.

Particularly, if the monitor area is an area which is used daily such as the user's home, etc., the user may believe that the monitor area is safe, and there is a high probability that the user will carelessly enter the monitor area.

To solve this problem, a monitoring system for sending a notice to the outside of a monitor area or a terminal of the user (user terminal), thereby informing the user of an anomaly in the monitor area is known. However, even such a monitoring system involves a possibility that the user may fail to notice the message (information) sent to the outside of the monitor area or the user terminal.

SUMMARY OF THE INVENTION

It is therefore an object of the invention to provide a monitoring method, a monitoring system, a monitoring program and (a record medium recording the monitoring program), where when an anomaly occurs in the monitor area, it is possible to reliably and simply block careless entry of the user into the monitor area.

To this end, according to one aspect of the invention, there is provided a monitoring method of monitoring one monitor area, including a door open control step of hindering opening of a door placed at an entrance to the monitor area if an anomaly in the monitor area is detected.

Installation of a monitoring system for monitoring a user's home, an automobile, etc., as a monitor area has become widespread due to a rise in security awareness. The invention can be easily and simply embodied using an already existing monitoring system.

Various door open hindrance methods can be used in response to how each door is opened and closed. For example, if the door is provided with a locking unit, a method of keeping the door locked even if an attempt is made to unlock the locking unit using a key can be used. If the door is an automatic door, a method of stopping the operation of a drive for driving the opening/closing operation of the automatic door can be used, or a sensor used as a trigger of the opening/closing operation of the automatic door as the approach of a human being is detected can be used. If the door is provided with a knob and a unit for enabling the door to be opened/closed as the knob is rotated or moved, a method of hindering rotation or movement of the knob can be used.

According to a method according to an embodiment of the invention, if an anomaly in the monitor area is detected, opening the door positioned at the entrance to the monitor area is hindered, so that entry of a human being into the monitor area through the entrance can be hindered. Therefore, if the user fails to notice a notification sent to the outside of the monitor area or to the user terminal, entry of the user into the monitor area can be reliably hindered. Consequently, an accident can be avoided wherein the user carelessly enters the monitor area without being aware of the danger in the monitor area and suffers some injury.

The monitoring method according to the invention may further include a communication step of sending notification concerning the anomaly to a user terminal, i.e., a terminal of the user, upon detection of the anomaly in the monitor area and receiving acknowledgement of the notification from the user terminal, wherein if the acknowledgement of the notification is received in the communication step, the door open control step releases hindering of opening the door.

As the user cannot enter the monitor area, he or she can recognize that some situation has occurred, or is forced to recognize a danger. At this time, the notification concerning the danger is sent to the user terminal according to the monitoring method and therefore the user can be made aware of the anomaly in the monitor area by referencing the user terminal.

That is, if the user fails to notice the notification received at the user terminal, the user can be made aware of the presence of the notification as he or she cannot enter the monitor area. Therefore, the user can be informed of the anomaly in the monitor area with high accuracy.

Hindering of opening the door is released only if acknowledgement of the notification is received in the communication step. That is, the user can perform usual door opening operations to enter the monitor area only if he or she sends the acknowledgement of the notification from the user terminal. Therefore, the user can always be aware of the anomaly in the monitor area before entering the monitor area.

In a monitoring method according to an embodiment of the invention, the communication step may send information indicating occurrence of the anomaly to the user terminal and receive acknowledgement of occurrence of the anomaly from the user terminal. Upon reception of the acknowledgement, the communication step may send the contents of the anomaly to the user terminal.

In the above-described case, it is a concern that the user may forget about sending an acknowledgement of the notification concerning the anomaly from the user terminal. In this case, hindering of opening the door is maintained. Therefore, even if the user keeps track of the anomaly by referencing the notification at the user terminal, the user cannot enter the monitor area for an indefinite time.

In contrast, according to a monitoring method according to an embodiment of the invention, first a message indicating occurrence of the anomaly is sent to the user terminal. The contents of the anomaly are not sent to the user terminal until acknowledgement of occurrence of the anomaly is received from the user terminal. At this time, the user can be aware of the occurrence of the anomaly by referencing the user terminal, but needs to send acknowledgement of occurrence of the anomaly from the user terminal to learn the contents of the anomaly and grasp the anomaly. Accordingly, the user can be prevented from forgetting about sending the acknowledgement from the user terminal.

In the monitoring method according to an embodiment of the invention, if an anomaly in the monitor area is detected, the user approaching the monitor area is detected, and the acknowledgement of the notification is not received in the communication step, the door open control step may hinder opening of the door.

According to the monitoring method, opening of the door is hindered only if the user approaches the monitor area and the acknowledgement of the notification is not received. Accordingly, the hindering processing of opening the door is performed only while there is a possibility that the user may enter the monitor area and the user does not acknowledge the notification at the user terminal, so that efficient processing can be performed.

According to another aspect of the invention, there is provided a monitoring system for monitoring one monitor area, including an anomaly detection section for detecting an anomaly in the monitor area; a door open hindrance section for hindering opening of a door placed at an entrance to the monitor area; and an open hindrance control section for controlling the door open hindrance section so as to hinder opening of the door if the anomaly detection section detects an anomaly.

As the door open hindrance section, any of various units can be used in response to the type of door opening/closing unit.

According to one configuration, if the anomaly detection section detects an anomaly in the monitor area, the door open hindrance section hinders opening of the door placed at the entrance to the monitor area under the control of the open hindrance control section. Accordingly, entry of a human being into the monitor area through the entrance can be hindered.

Therefore, if the user fails to notice a notification sent outside of the monitor area or to the user terminal, entry of the user into the monitor area can be hindered reliably. Consequently, an accident can be avoided wherein the user enters the monitor area carelessly without being aware of the danger in the monitor area and suffers some injury.

The monitoring system according to the invention may further include a communication section for communicating with a user terminal, a terminal of a user; and a communication control section for controlling the communication section so as to transmit a notification concerning the anomaly detected by the anomaly detection section to the user terminal and to receive acknowledgement of the notification from the user terminal, wherein if the communication section receives the acknowledgement of the notification, the open hindrance control section controls the door open hindrance section so as to release hindering of opening the door.

As the user cannot enter the monitor area, he or she can recognize that some situation has occurred, or is forced to recognize a danger. At this time, the notification concerning the danger is transmitted to the user terminal according to the configuration and therefore the user can be made aware of the anomaly in the monitor area by referencing the user terminal.

That is, if the user fails to notice the notification received at the user terminal, the user can be made aware of the presence of the notification as he or she cannot enter the monitor area. Therefore, the user can be informed of the anomaly in the monitor area with high accuracy.

The open hindrance control section controls the door open hindrance section so as to release hindering of opening the door only if acknowledgement of the notification concerning the anomaly in the monitor area is received from the user terminal. That is, the user can enter the monitor area only if he or she sends the acknowledgement of the notification from the user terminal. Therefore, the user can always be made aware of the anomaly in the monitor area before entering the monitor area.

In the monitoring system according to the invention, the communication control section may control the communication section so as to transmit information indicating occurrence of the anomaly to the user terminal and receive acknowledgement of occurrence of the anomaly from the user terminal and upon reception of the acknowledgement, transmit the contents of the anomaly to the user terminal.

In the above-described case, it is a concern that the user will forget about sending acknowledgement of the notification concerning the anomaly from the user terminal. In this case, hindering of opening the door is maintained and therefore even if the user keeps track of the anomaly by referencing the notification at the user terminal, the user cannot enter the monitor area for an indefinite time.

In contrast, according to a configuration according to an embodiment of the invention, the communication control section controls the communication section so as to first transmit a message indicating an occurrence of the anomaly to the user terminal, and does not transmit the contents of the anomaly to the user terminal until acknowledgement of occurrence of the anomaly is received from the user terminal. At this time, the user can be aware of the occurrence of the anomaly by referencing the user terminal, but needs to transmit acknowledgement of occurrence of the anomaly from the user terminal to be made aware of the contents of the anomaly and grasp the anomaly. Accordingly, the user can be prevented from forgetting about transmitting the acknowledgement from the user terminal.

The monitoring system according to the invention may further include an approach detection section for detecting the user approaching the monitor area, wherein if the anomaly detection section detects an anomaly, the approach detection section detects the user approaching the monitor area, and the communication section does not receive the acknowledgement of the notification, the open hindrance control section controls the door open hindrance section so as to hinder opening of the door.

According to a configuration according to one embodiment of the invention, the open hindrance control section controls the door open hindrance section so as to hinder opening of the door only if the user approaches the monitor area and the acknowledgement of the notification is not received. Accordingly, the hindering operation of opening the door is performed only while there is a possibility that the user may enter the monitor area and the user does not acknowledge the notification at the user terminal, so that efficient operation can be performed.

A computer can be caused to execute the steps of the monitoring method as a monitoring program. Further, the monitoring program may be stored on a computer-readable record medium, whereby the monitoring method can be executed on any desired computer.

BRIEF DESCRIPTION OF THE DRAWINGS

In the accompanying drawings:

FIG. 8A shows the presence of a danger message and FIG. 8B shows the contents of the danger message.

DESCRIPTION OF THE PREFERRED EMBODIMENTS

Figure 1:
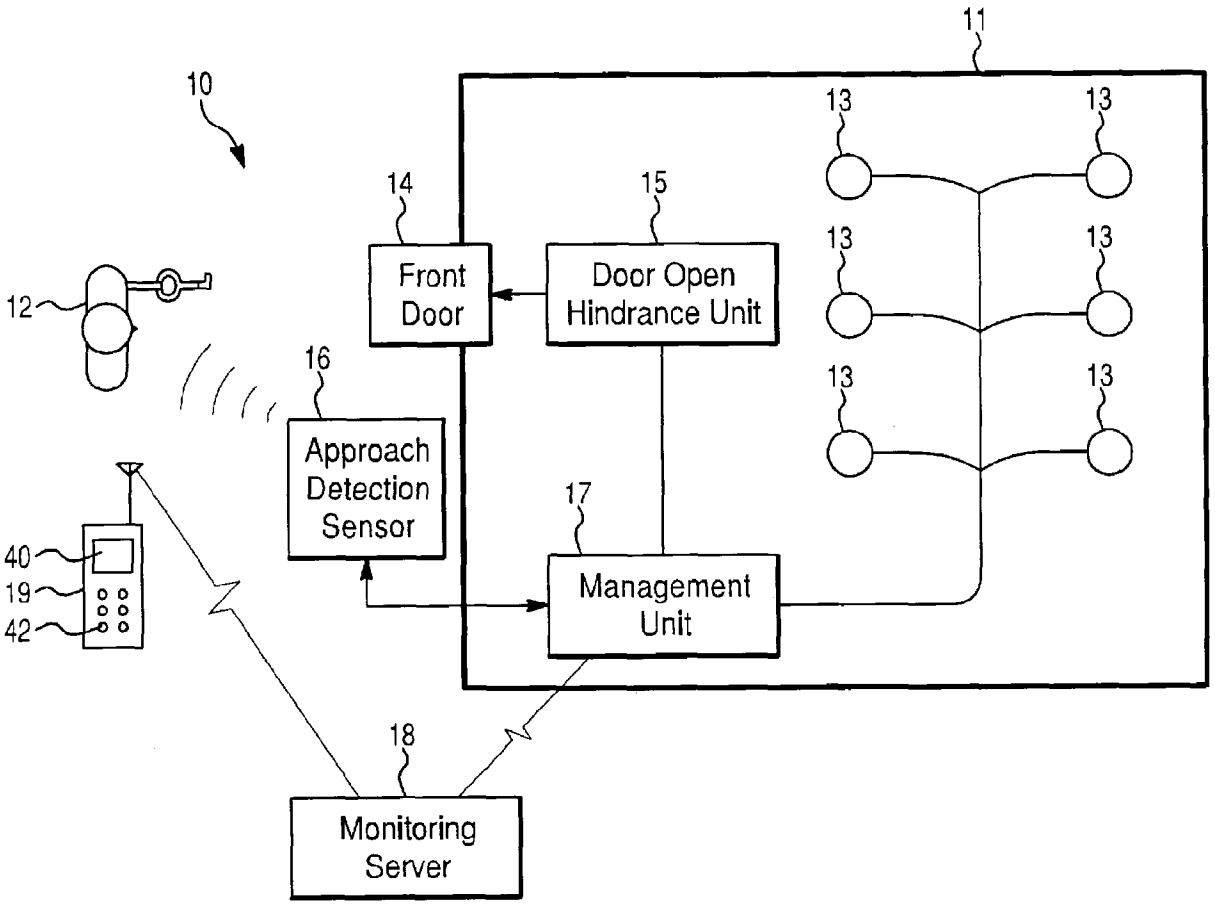
FIG. 1 is a block diagram illustrating a schematic configuration of a monitoring system according to an embodiment of the invention.

First Embodiment:

A first embodiment of the invention will be discussed with reference to FIGS. 1 to 7. FIG. 1 shows a monitoring system of the first embodiment. A monitoring system 10 of this embodiment monitors the inside of a house 11. If the monitoring system 10 determines that the inside of the house 11 is dangerous because of a fire, a suspicious person breaking into the house, etc., the monitoring system 10 prevents a resident 12 of the house 11, the user of the monitoring system 10, from entering the house 11.

The monitoring system 10 of this embodiment sends notice that the inside of the house 11 is dangerous via a management unit 17 through a monitor server 18 to a user terminal 19 of the resident 12. When the management unit 17 receives acknowledgement of reception of the notice at the user terminal 19 from the resident 12 through the monitor server 18, the monitoring system 10 releases blocking entry of the resident 12 into the house 11.

The monitoring system 10 of this embodiment includes a plurality of sensors 13 . . . , a door open hindrance unit 15, an approach detection sensor 16, and the above-mentioned management unit 17 within and surrounding the house 11 as the monitor area. The monitoring system 10 also includes the user terminal 19 of the resident 12 and the monitor server 18 that can conduct data communications with the management unit 17 and the user terminal 19.

The data communications between the management unit 17 and the user terminal 19 and the monitor server 18 can be conducted using any desired communication networks, such as the Internet and telephone lines (including ISDN (Integrated Services Digital Network), PHS (Personal Handyphone System®) lines, mobile telephone lines, etc., either singly or in combination. It is desirable that the data communications between the user terminal 19 and the monitor server 18 should be conducted using a radio communication network of a mobile telephone line, etc.

Next, the components of the monitoring system 10 of this embodiment will be discussed. The sensors 13 detect various phenomena and are placed at appropriate points in the house 11. Each sensor 13 transmits detection information to the management unit 17 as a detection signal.

Various sensors can be used as the sensors 13. For example, photoelectric sensors, beam sensors, ultrasonic sensors, and infrared sensors can be used as sensors for detecting a human body, etc. Vibration sensors and acceleration sensors can be used as sensors for detecting motion, breakage, etc., of an object. Microphones, sound sensors, and acoustic sensors can be used as sensors for detecting sound. Video cameras can be used as sensors for detecting video. Temperature sensors, smoke sensors, and humidity sensors can be used as sensors for detecting a fire, etc.

In addition, various devices such as capacitance level sensors, capacitance-operated intrusion sensors, current sensors, voltage sensors, lead switches for detecting opening/closing of a door, and clocks for detecting time are available. The sensors 13 include not only devices generally called "sensors," but also any machine capable of detecting a phenomenon, converting the detection result into an electric signal, etc., and sending the electric signal to the management unit 17.

The door open hindrance unit 15 is a unit for hindering the opening of a front door 14 positioned at the entrance of the house 11 based on an instruction from the management unit 17. The door open hindrance unit 15 can use any of various units in response to the type of unit involved in opening/closing the front door 14.

For example, if the front door 14 is provided with a locking unit, the door open hindrance unit 15 is a unit for keeping the door locked if an attempt is made to unlock the locking unit using a key. If the front door 14 is an automatic door, the door open hindrance unit 15 is a unit for stopping the operation of a drive for driving the opening/closing operation of the automatic door, or a sensor used to trigger the opening/closing operation of the automatic door as it detects the approach of a human being. If the front door 14 is provided with a knob and a unit for enabling the door to be opened/closed as the knob is rotated or moved, the door open hindrance unit 15 is a unit for hindering the rotation or movement of the knob.

The approach detection sensor 16 is a sensor for detecting an object approaching the front door 14. The approach detection sensor 16 may be a sensor for emitting radio waves, ultrasonic waves, etc., and sensing an object from its reflected wave. The approach detection sensor 16 may be a sensor for sensing an object as the object blocks a beam of infrared radiation, or the like. It is desirable that the approach detection sensor 16 should be able to determine whether or not the approaching object is the resident 12. To determine whether or not the approaching object is the resident 12, for example, an ID tag may be previously attached to the resident 12 and may be read by the approach detection sensor 16.

The management unit 17 has a similar configuration to that of a general computer. That is, the management unit 17 includes a central processing unit (CPU), a storage unit, and an interface for interfacing with the external units 13, 15, 16, and 18. As the central processing unit executes a program stored in the storage unit, the management unit 17 performs various types of operations.

Figure 2:
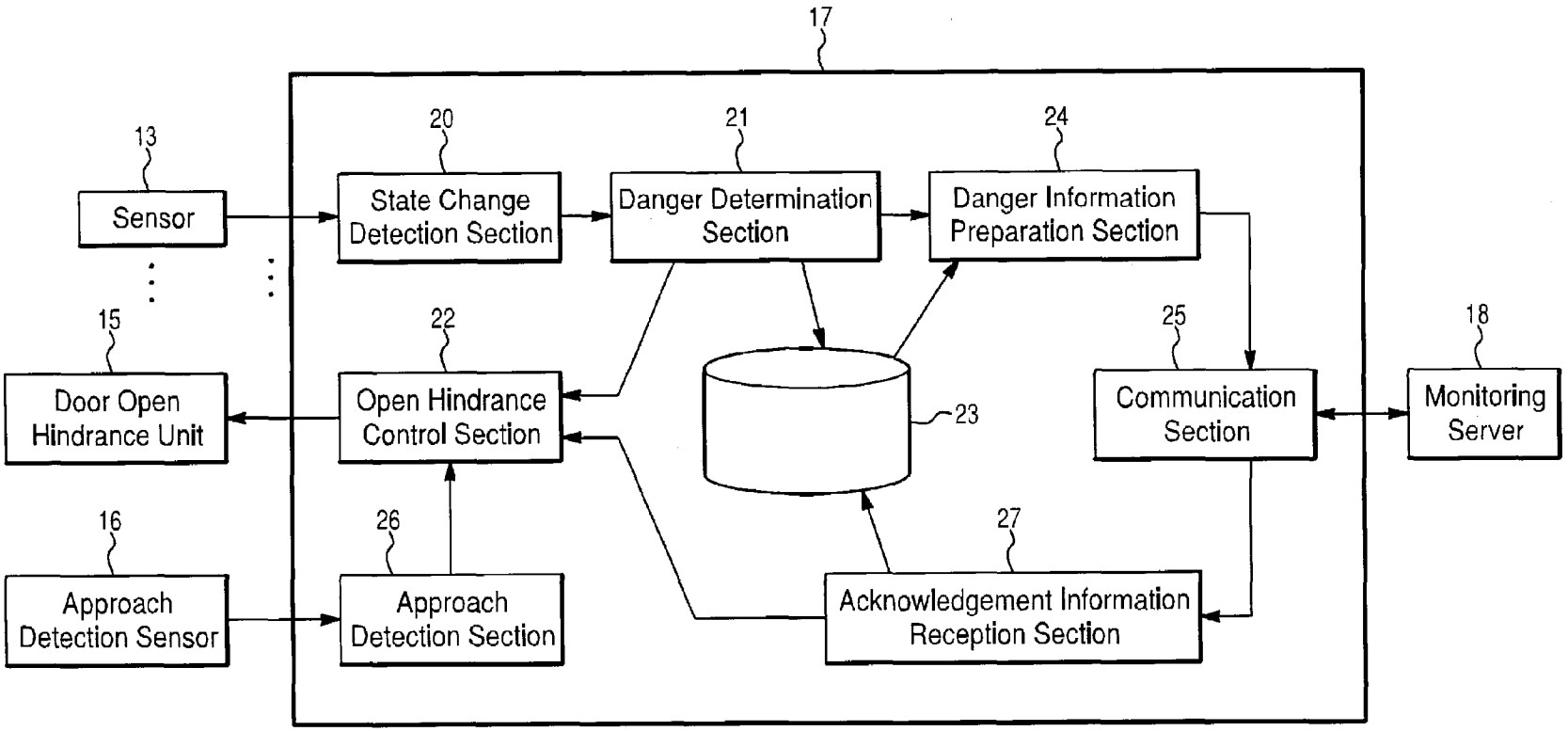
FIG. 2 is a block diagram illustrating various functions of a management unit in an embodiment of the invention.

FIG. 2 illustrates the functions of the management unit 17 as a state change detection section 20, a danger determination section 21, an open hindrance control section 22, a danger information preparation section 24, a communication section 25, an approach detection section 26, and an acknowledgement information reception section 27. The functions of the management unit 17 will be discussed below:

The state change detection section 20 receives detection information from the sensors 13, and senses whether or not a change has occurred in the state of the house 11 based on the detection information. If the state change detection section 20 detects a change, it sends the state change contents to the danger determination section 21.

The danger determination section 21 determines the situation occurring in the house 11 from the state change contents received from the state change detection section 20, and determines whether or not entry of the resident 12 into the house 11 would be dangerous based on the determined situation. The functions of the change state change detection section 20 and the danger determination section 21 will be discussed more specifically.

As one example, if the state change detection section 20 detects a rapid temperature rise based on temperature information from a temperature sensor 13 placed in the house 11, it sends the change contents of the temperature rise rate, the raised temperature, or the like to the danger determination section 21. If the danger determination section 21 determines that a fire has occurred from the change contents received from the state change detection section 20, it determines that entry into the house is dangerous.

As another example, if the state change detection section 20 detects movement of an object based on video information from a video camera 13 positioned in the house 11, it sends the change contents of the dimensions, the movement position, etc., of the object to the danger determination section 21. If the danger determination section 21 determines that an intrusion of a suspicious person has occurred from the change contents received from the state change detection section 20, it determines that entry into the house 11 is dangerous.

If the danger determination section 21 determines that entry of the resident 12 into the house 11 is dangerous, it informs the open hindrance control section 22 of the danger and also informs the danger information preparation section 24 of the occurring situation. The danger determination section 21 also stores the occurring situation in an information DB (database) 23 of a part of the storage unit.

The danger information preparation section 24 prepares danger information, including the occurring situation and supplementary information such as the identification number of the house 11, the occurrence time, etc., and sends the danger information to the communication section 25. The communication section 25 converts the danger information received from the danger information preparation section 24 into a format suited for data communications with the monitoring server 18 and then transmits the provided information to the monitoring server 18.

Upon reception, from the monitoring server 18 of acknowledgement information indicating that the resident 12 has acknowledged that the inside of the house 11 is dangerous, the communication section 25 converts the acknowledgement information into a format suited for processing in the management unit 17. The communication section 25 then sends the provided information to the acknowledgement information reception section 27. Upon reception of the acknowledgement information through the communication section 25 from the monitoring server 18, the acknowledgement information reception section 27 informs the open hindrance control section 22 of reception of the acknowledgement information and stores an indication of the reception of the acknowledgement information in the information DB 23.

If the approach detection section 26 detects the resident 12 approaching the front door 14 by the approach detection sensor 16, it informs the open hindrance control section 22 of the resident 12 approaching.

Upon reception of information indicating that entry of the resident 12 into the house 11 is dangerous from the danger determination section 21 and reception of the information indicating that the resident 12 is approaching the front door 14 from the approach detection section 26, the open hindrance control section 22 actuates the door open hindrance unit 15, whereby opening of the front door 14 is hindered. Upon reception of the information indicating that the resident 12 acknowledges that the inside of the house 11 is dangerous from the acknowledgement information reception section 27, the open hindrance control section 22 stops operation of the door open hindrance unit 15, whereby it is made possible to open the front door 14.

The monitoring server 18 has a configuration similar to that of a general computer. That is, the monitoring server 18 includes a central processing unit, a storage unit, and an interface for interfacing with the external units 17 and 19. As the central processing unit executes programs stored in the storage unit, the monitoring server 18 performs various types of operation.

Figure 3:
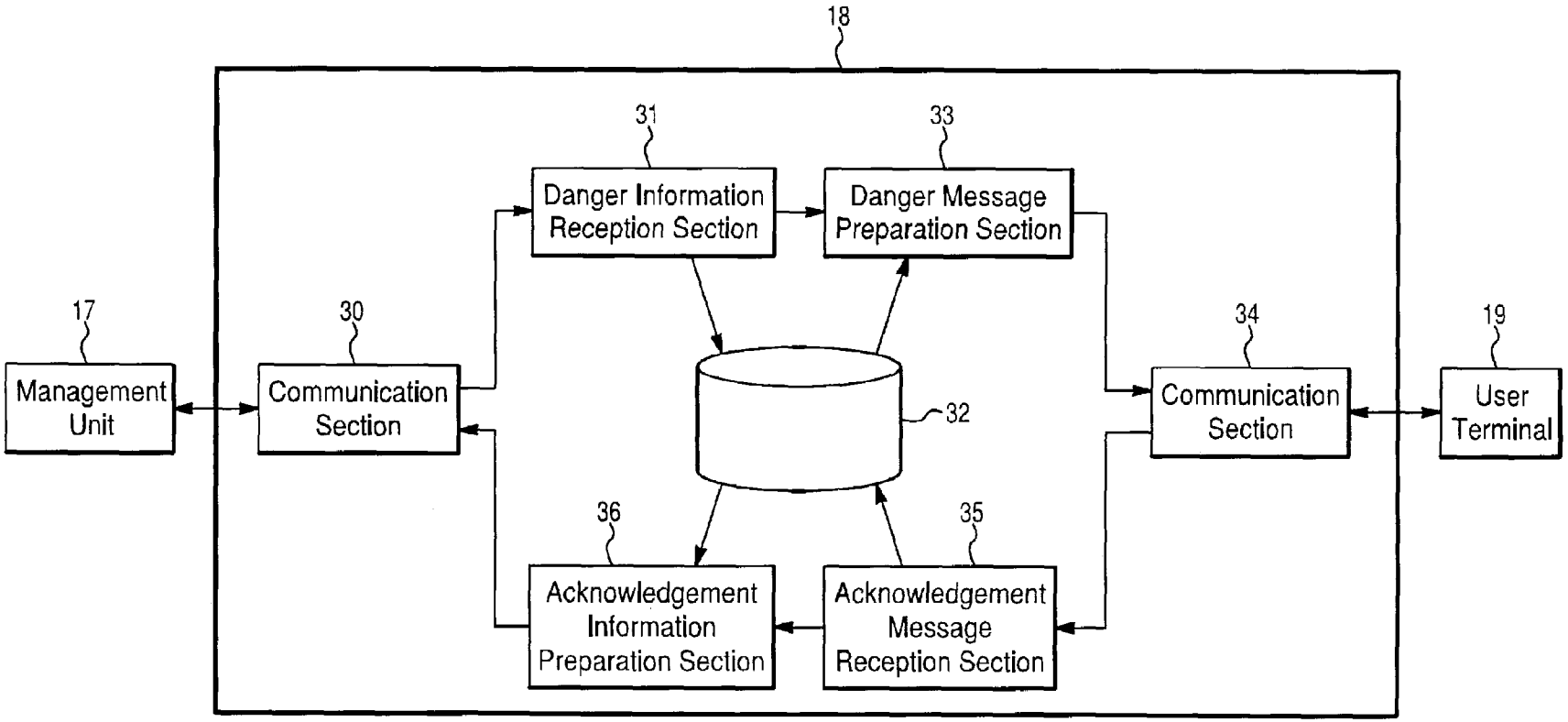
FIG. 3 is a block diagram illustrating various functions of a monitoring server in an embodiment of the invention.

FIG. 3 illustrates the functions of the monitoring server 18 including a monitor communication section 30, a danger information reception section 31, a danger message preparation section 33, a user communication section 34, an acknowledgement message reception section 35, and an acknowledgement information preparation section 36. The functions of the monitoring server 18 will be discussed below:

Upon reception of the danger information indicating that the inside of the house 11 is dangerous from the management unit 17, the monitor communication section 30 converts the danger information into a format suitable for processing in the monitoring server 18. The monitor communication section 30 then sends the provided information to the danger information reception section 31. Upon reception of the danger information through the monitor communication section 30 from the management unit 17, the danger information reception section 31 sends the contents of the danger information to the danger message preparation section 33 and stores the contents of the danger information in an information DB 32 of a part of the storage unit.

The danger message preparation section 33 determines that the user terminal 19 is informed of the danger by retrieving information in the information DB 32 based on the contents of the danger information received from the danger information reception section 31. The danger message preparation section 33 then prepares a danger message suitable for the determined user terminal 19 and then sends the prepared danger message to the user communication section 34.

The user communication section 34 converts the danger message received from the danger message preparation section 33 into a format suitable for data communications with the user terminal 19 determined by the danger message preparation section 33 and then transmits the provided message to the user terminal 19.

Upon reception of an acknowledgement message indicating that the resident 12 acknowledges that the inside of the house 11 is dangerous from the user terminal 19, the user communication section 34 converts the acknowledgement message into a format suitable for processing in the monitoring server 18 and then sends the provided acknowledgement message to the acknowledgement message reception section 35.

Upon reception of the acknowledgement message through the user communication section 34 from the user terminal 19, the acknowledgement message reception section 35 informs the acknowledgement information preparation section 36 of the contents of the acknowledgement message and stores the contents of the acknowledgement message in the information DB 32.

The acknowledgement information preparation section 36 determines that the management unit 17 is informed of the acknowledgement by retrieving information from the information DB 32 based on the acknowledgement message received from the acknowledgement message reception section 35. The acknowledgement information preparation section 36 prepares acknowledgement information suited for the determined management unit 17 and then sends the prepared acknowledgement information to the monitor communication section 30.

The monitor communication section 30 converts the acknowledgement information received from the acknowledgement information preparation section 36 into a format suitable for data communications with the management unit 17 determined by the acknowledgement information preparation section 36 and then transmits the provided acknowledgement information to the management unit 17.

The user terminal 19 may be a mobile telephone terminal at present. The mobile telephone terminal has a configuration similar to that of a general computer. That is, the user terminal 19 includes a central processing unit, a storage unit, and an interface for interfacing with the monitoring server 18. As the central processing unit executes programs stored in the storage unit, the user terminal 19 performs various types of operation.

The user terminal 19 also includes a display such as an LCD (liquid crystal display) or an ELD (electroluminescence display) for displaying various pieces of information for the user, an announcement device such as a loudspeaker, an LED (light emitting diode), or a vibrator for reporting an incoming call, etc., to the user by sound, light, vibration, etc., and an input unit for the user to enter various pieces of information. As an example of the described user terminal 19, a PDA (personal digital assistant) and a notebook computer may be used in addition to the mobile telephone terminal described above.

Figure 4:
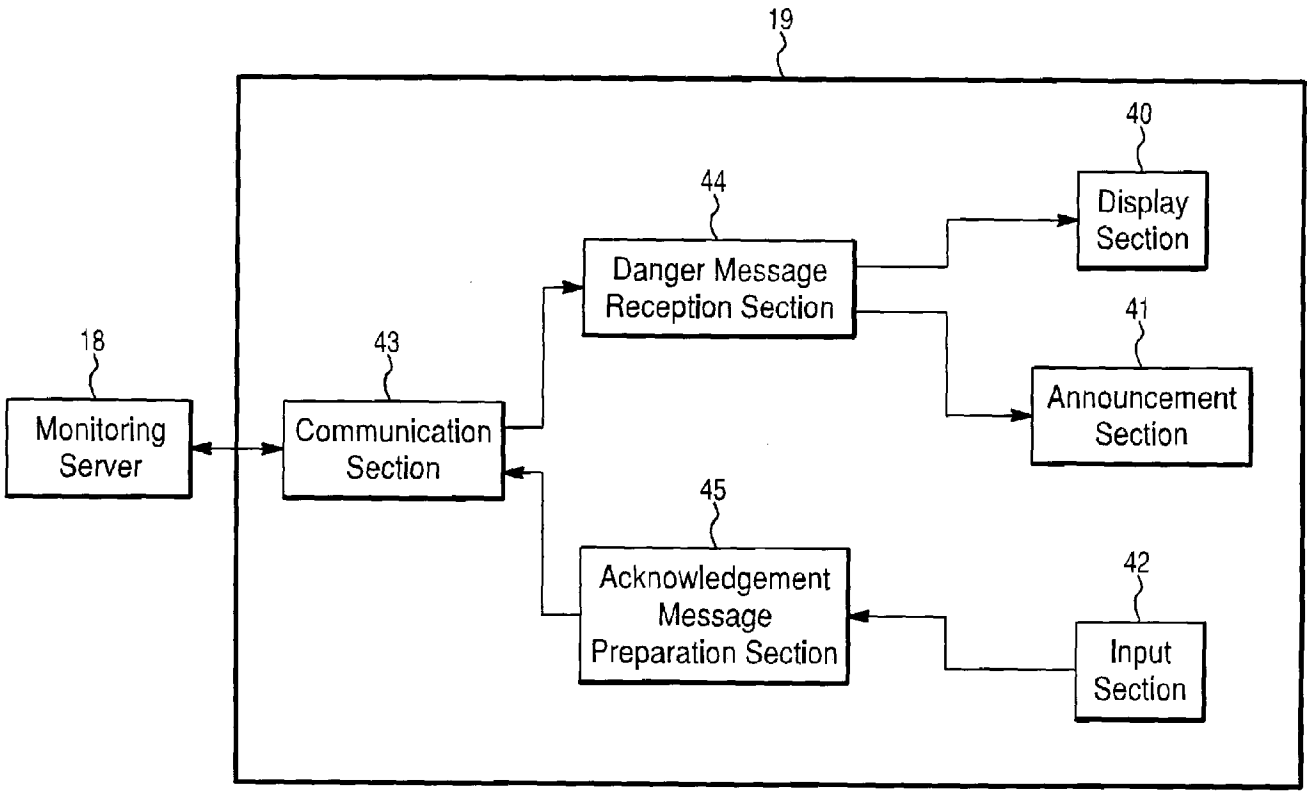
FIG. 4 is a block diagram illustrating various functions of a user terminal in an embodiment of the invention.

FIG. 4 shows the functions of the user terminal 19 as a display section 40, an announcement section 41, an input section 42, a communication section 43, a danger message reception section 44, and an acknowledgement message preparation section 45. The functions of the user terminal 19 will be discussed below:

The display section 40 converts information to be displayed into a format suitable for the display and transmits the provided information to the display. The announcement section 41 generates a control signal suitable for the announcement operation of an announcement device and transmits the control signal to the announcement device.

The input section 42 converts an input signal from the input unit into a format suitable for processing in the user terminal 19. The communication section 43 converts information received from the monitoring server 18 into a format suitable for processing in the user terminal 19 and also converts information to be transmitted to the monitoring server 18 into a format suitable for data communications with the monitoring server 18.

Upon reception of a danger message through the communication section 43 from the monitoring server 18, the danger message reception section 44 displays the danger message on the display through the display section 40. The danger message reception section 44 also actuates the announcement device through the announcement section 41, thereby informing the resident 12 of the arrival of the danger message.

Upon reception of an acknowledgement signal indicating that the user has acknowledged the danger message through the input section 42 (the user presses an acknowledgment button (not shown) on the input unit or the like), the acknowledgement message preparation section 45 prepares an acknowledgement message including the acknowledgement, the identification number of the user terminal 19, etc. The prepared acknowledgement message is transmitted through the communication section 43 to the monitoring server 18.

The operation of the management unit 17, the monitoring server 18, and the user terminal 19 described above will be discussed with reference to FIGS. 5 to 7.

Figure 5:
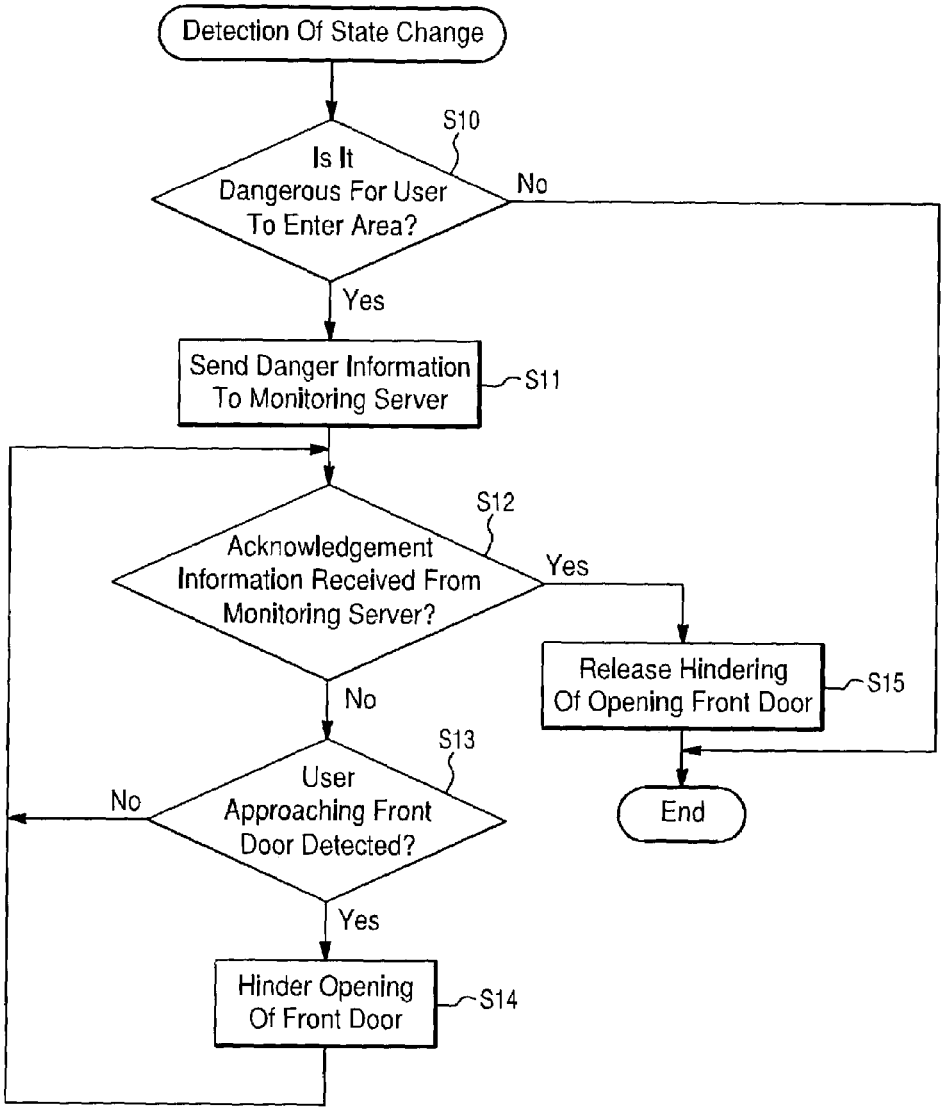
FIG. 5 is a flowchart illustrating the processing operation of the management unit in an embodiment of the invention.

FIG. 5 shows the processing operation of the management unit 17 upon detection of a state change based on a detection signal from the sensor 13. First, the management unit 17 detects the occurring situation based on the detected state change and determines whether or not it is dangerous for the resident 12 to enter the house 11 because of the occurring situation (step S10). If it is determined that it is not dangerous for the resident 12 to enter the house 11, the processing operation started upon detection of the state change is terminated.

On the other hand, if the management unit 17 determines that it is dangerous for the resident 12 to enter the house 11, the management unit 17 prepares danger information and sends the danger information to the monitoring server 18 (step S11). If the management unit 17 detects the user approaching the front door 14 (YES at step S13) before receiving acknowledgement information from the monitoring server 18 (NO at step S12), the management unit 17 instructs the door open hindrance unit 15 to hinder opening of the front door 14 (step S14).

Upon reception of acknowledgement information from the monitoring server 18 (YES at step S12), the management unit 17 instructs the door open hindrance unit 15 to release hindering of opening the front door 14 (step S15) and then terminates the processing operation started upon detection of the state change.

If the management unit 17 receives acknowledgement information from the monitoring server 18 before detecting the user 12 approaching the front door 14, it terminates the processing operation started upon detection of the state change without instructing the door open hindrance unit 15 to hinder opening of the front door 14.

Figure 6:
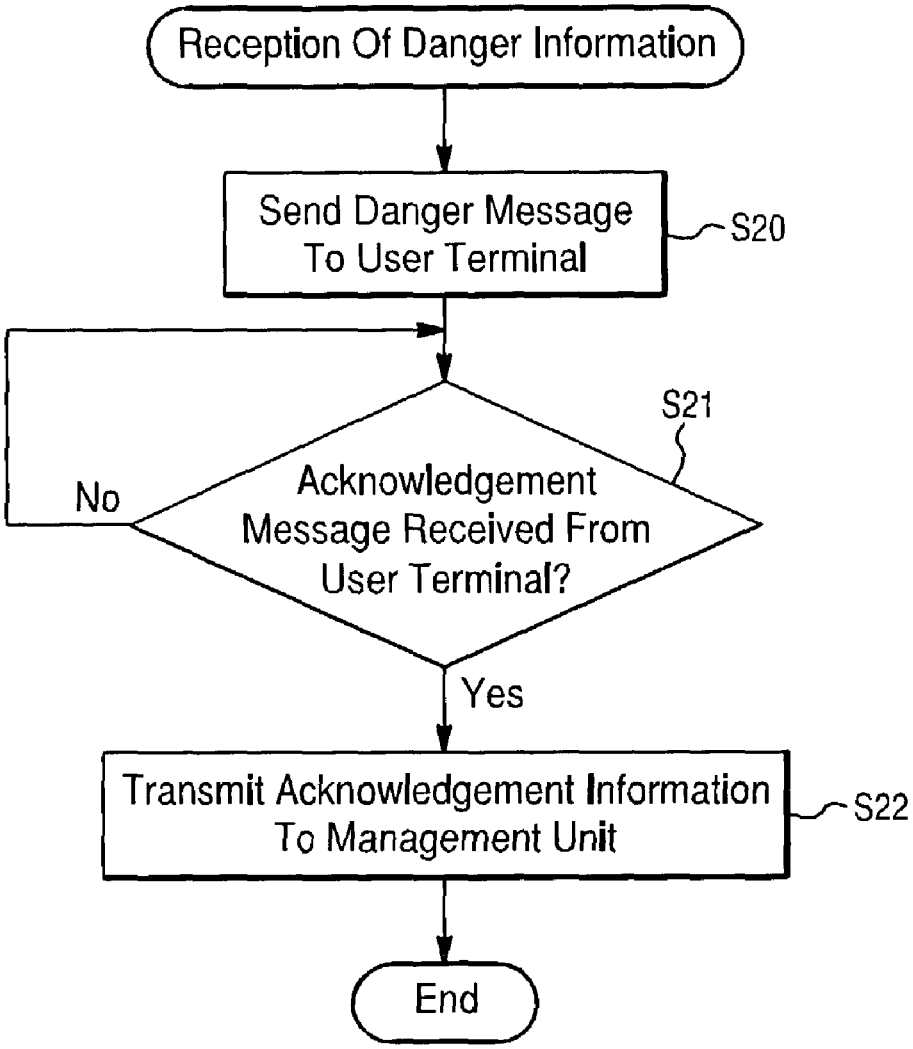
FIG. 6 is a flowchart illustrating the processing operation of the monitoring server in an embodiment of the invention.

FIG. 6 illustrates the processing operation of the monitoring server 18 upon reception of danger information from the management unit 17. First, the monitoring server 18 prepares a danger message based on the received danger information and sends the danger message to the user terminal 19 (step S20).

Then, the monitoring server 18 waits until receiving an acknowledgement message indicating that the user acknowledges the danger message from the user terminal 19 (step S21). Upon reception of the acknowledgement message from the user terminal 19, the monitoring server 18 prepares acknowledgement information based on the received acknowledgement message and transmits the acknowledgement information to the management unit 17 (step S22) and then terminates the processing operation started upon reception of the danger information.

Figure 7:
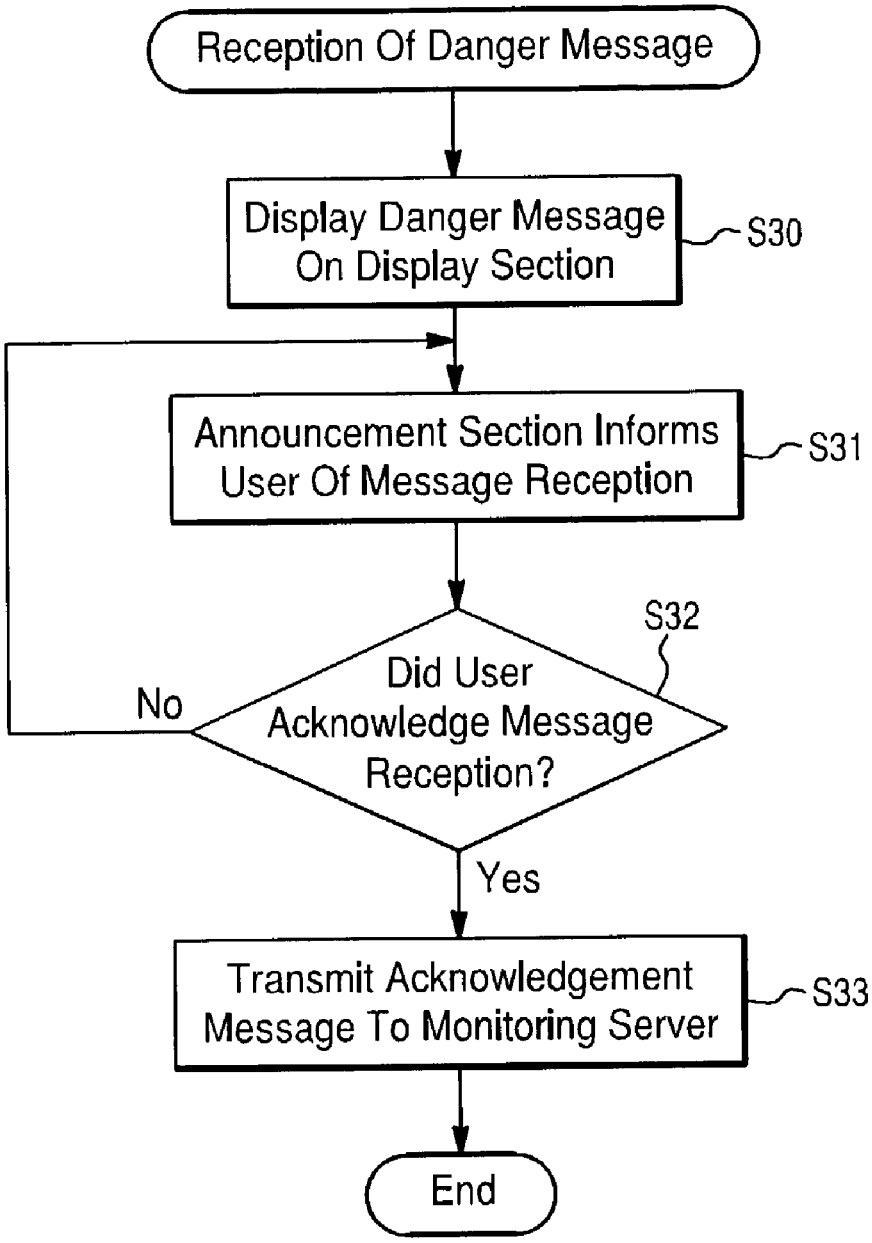
FIG. 7 is a flowchart illustrating the processing operation of the user terminal in an embodiment of the invention.

FIG. 7 illustrates the processing operation of the user terminal 19 upon reception of a danger message from the monitoring server 18. First, the user terminal 19 displays a received danger message on the display section 40. Next, the announcement section 41 continues to inform the user 12 that a danger message is received until the user 12 acknowledges the danger message (steps S31 and S32). When the user 12 acknowledges the danger message, the user terminal 19 prepares an acknowledgement message and transmits the acknowledgement message to the monitoring server 18 (step S33) and then terminates the processing operation started upon reception of the danger message.

Therefore, in the monitoring system 10 of this embodiment, if the management unit 17 determines that the inside of the house 11 is dangerous, it instructs the door open hindrance unit 15 to hinder opening of the front door 14, so that entry of the resident 12 into the house 11 through the front door 14 can be hindered. Accordingly, if the resident 12 fails to notice the message (information) sent to the outside of the house 11 or the user terminal 19, entry of the resident 12 into the house 11 can be reliably hindered. Consequently, an accident can be avoided wherein the resident 12 carelessly enters the house 11 without being aware of the danger in the house 11 and suffers some injury.

As the resident 12 cannot enter the house 11, he or she is forced to recognize that the inside of the house 11 is dangerous. At this time, the management unit 17 transmits notification concerning the danger in the house 11 (danger message) to the user terminal 19 through the monitoring server 18 and therefore the resident 12 can be made aware of the danger in the house 11 by referencing the user terminal 19.

That is, if the resident 12 at first fails to notice the notification concerning the danger received at the user terminal 19, the resident 12 can be made aware of the presence of the notification as he or she cannot enter the monitor area 11. Therefore, the resident 12 can be informed of the danger in the house 11 with high accuracy.

The management unit 17 instructs the door open hindrance unit 15 to release hindering of opening the front door 14 only if the management unit 17 receives acknowledgement of the notification concerning the danger in the house 11 from the user terminal 19. That is, the resident 12 can enter the house 11 only if he or she transmits the acknowledgement from the user terminal 19. Therefore, the resident 12 can always be made aware of the danger in the house 11 before entering the house 11.

The management unit 17 instructs the door open hindrance unit 15 to hinder opening of the front door 14 only if the management unit 17 detects the resident 12 approaching the house 11 by means of the approach detection sensor 16 and also does not receive an acknowledgement of the notification from the user terminal 19. Accordingly, the hindering operation of opening the front door 14 is performed only while there is a possibility that the resident 12 may enter the house 11 and the resident 12 has not acknowledged the notification at the user terminal 19, so that efficient operation can be performed.

Second Embodiment:

Next, a second embodiment of the invention will be discussed. A monitoring system of the second embodiment differs from the monitoring system 10 previously described with reference to FIGS. 1 to 7 only in operation of sending a message from the monitoring server 18 to the user terminal 19. Components and operations similar to those previously described with reference to FIGS. 1 to 7 in the first embodiment are denoted by the same reference numerals in the second embodiment and will not be discussed again.

In the first embodiment, it is a concern that the resident 12 will forget about transmitting an acknowledgement message from the user terminal 19. In this case, hindering of opening the door is maintained. Therefore even if the resident 12 is made aware of the danger in the house 11 by referencing the notification at the user terminal 19, the resident 12 cannot enter the house 11 for an indefinite time.

In contrast, in the second embodiment, a monitoring server 18 first sends the presence of a danger message to a user terminal 19, but does not send the contents of the danger message before receiving an acknowledgement message from the user terminal 19. At this time, a resident 12 can be made aware of the presence of a danger message by referencing the user terminal 19, but must transmit an acknowledgement message from the user terminal 19 to be informed of the contents of the danger message and grasp the danger in house 11. Accordingly, the resident 12 can be prevented from forgetting about transmitting the acknowledgement message from the user terminal 19.

Figure 8A:
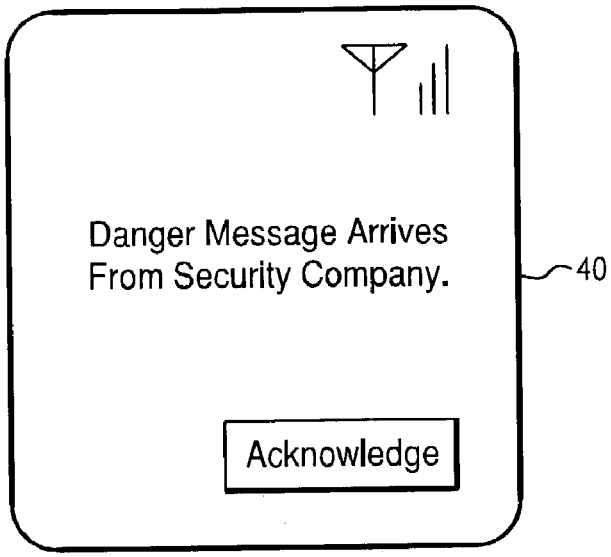
FIGS. 8A and 8B are schematic drawings illustrating danger messages displayed on a display section of a user terminal in another embodiment of the invention.
Figure 8B:
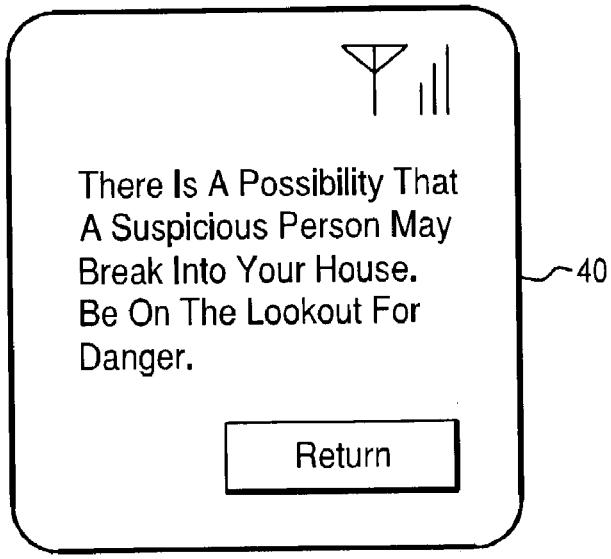
Figure 9:
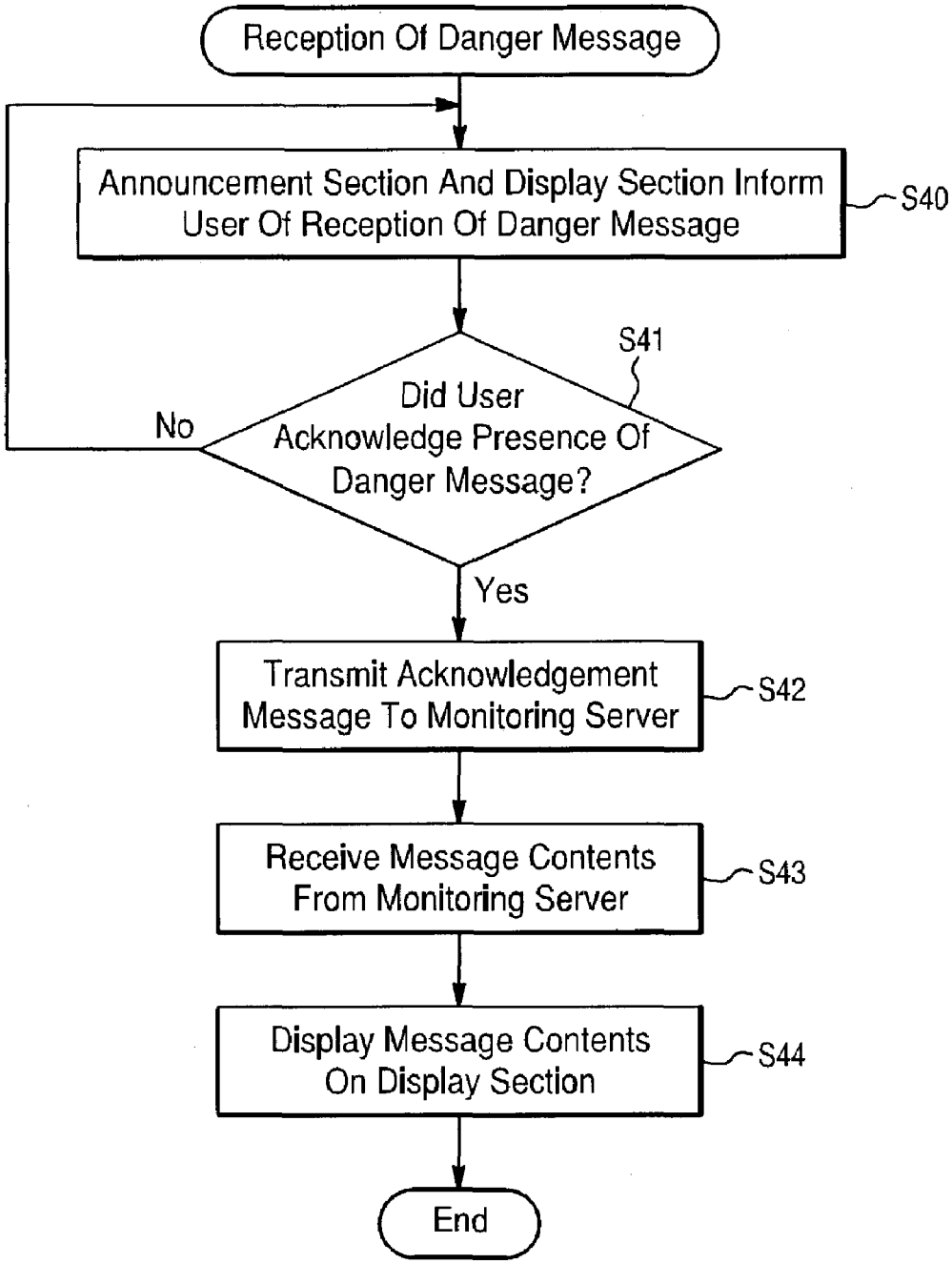
FIG. 9 is a flowchart illustrating the processing operation of the user terminal in another embodiment of the invention.

The monitoring system of this second embodiment will be discussed with reference to FIGS. 8A, 8B and 9. FIGS. 8A and 8B illustrate danger messages displayed on a display section 40 of the user terminal 19. FIG. 9 illustrates the processing operation of the user terminal 19 upon reception of a danger message.

First, the user terminal 19 displays reception of the presence of a danger message on the display section 40 as shown in FIG. 8A until the resident 12 acknowledges the presence of a danger message, and informs the resident 12 of reception of the presence of a danger message through an announcement section 41 (steps S40 and S41).

When the resident 12 acknowledges the presence of a danger message by pressing an acknowledge button, etc., (YES at step S41), the user terminal 19 prepares an acknowledgement message and transmits the acknowledgement message to the monitoring server 18 (step S42). At this time, the monitoring server 18 prepares acknowledgement information and transmits the acknowledgement information to a management unit 17 (S22 in FIG. 6) and also transmits the contents of the danger message to the user terminal 19 (not shown).

Upon reception of the contents of the danger message from the monitoring server 18 (step S43), the user terminal 19 displays the contents of the danger message on the display section 40 as shown in FIG. 8B (step S44) and then terminates the processing operation started upon reception of the danger message.

Therefore, in the monitoring system of the second embodiment, the monitoring server 18 transmits the contents of the danger message after the user acknowledges the presence of the danger message at the user terminal 19. At this time, the resident 12 must transmit an acknowledgement message from the user terminal 19 to be made aware the contents of the danger message and grasp the danger in the house 11. In this way, the resident 12 can be prevented from forgetting about transmitting the acknowledgement message from the user terminal 19.

It is to be understood that the invention is not limited to the specific embodiments and the combination and arrangement of parts may be resorted to without departing from the spirit and the scope of the invention as hereinafter claimed.

For example, in the embodiments, the opening of the front door 14 used for the resident 12 to enter the house 11 is hindered, but the opening of a door placed at any other doorway, such as a kitchen door, may be hindered. However, the unit for hindering opening of a door need not be placed at all doorways, and may be placed at a doorway through which the resident 12 can make his or her entrance and exit.

In the embodiments, the resident 12 approaching the house 11 is detected by the approach detection sensor 16. However, using the user terminal 19 having a global positioning satellite (GPS) function in place of the approach detection sensor 16, the management unit 17 can also acquire the position of the user terminal 19, and thus the position of the resident 12, through the monitoring server 18 from the user terminal 19. The resident 12 approaching the front door 14 may be thereby detected.

In the embodiments, if the resident 12 is approaching the house 11, opening of the front door 14 is hindered. However, if any human being other than the resident 12 is approaching the house 11, opening of the front door 14 may be hindered. In this case, inflicting an injury on the human being can be avoided.

In the embodiments, the management unit 17 detects a state change in the house 11 based on the detection signal from the sensor 13 . . . and detects occurrence of a situation. However, intelligent sensors may be used as the sensors 13 . . . for detecting a state change in the monitor area 11 and for further detecting the occurrence of a situation.

In the embodiments, communications between the management unit 17 and the user terminal 19 are conducted through the monitoring server 18. Communications can also be directly conducted, other than via the monitoring server 18. The monitoring server 18 can also have the functions of the management unit 17. In this case, the management unit 17 may have only the function of mediating between the sensors 13 . . . , the door open hindrance unit 15, and the approach detection sensor 16, and the monitoring server 18.

In the embodiments, the house 11 is set as the monitor area, but a moving object, such as an automobile, can also be adopted as the monitor area. Not only the inside of a partitioned area, but also the surroundings thereof can also be adopted as the monitor area.

In the embodiments, if the management unit 17 determines that entry of the resident 12 into the house 11 is dangerous, the management unit 17 hinders opening (unlocking) of the front door 14. However, since situations may exist where it is hard to determine whether or not entry of the resident 12 into the house 11 is dangerous, opening (unlocking) of the front door 14 may be hindered if a situation different from the usual situation, namely, an abnormal situation, is detected without determining whether the situation is dangerous.

For example, if the user's home is the monitor area, because the user's house is used daily, the user easily accesses his or her home and may encounter an unforeseen accident; the case where the user is prevented from encountering an unforeseen accident can be increased.

The programs executed for the management unit 17, the monitoring server 18, and the user terminal 19 to perform various types of processing, may be, for example, recorded on a removable medium such as a CD-ROM, and may be read for use, or may be installed on a hard disk, etc., and may be read for use. If the monitoring system 10 is connected to a communication network such as the Internet, it is also possible to download the programs through the communication network and install the programs on a hard disk, etc., for execution.

As described above, the monitoring method according to an embodiment of the invention is a method of monitoring one monitor area and includes a door open control step of hindering opening of a door placed at an entrance to the monitor area if an anomaly in the monitor area is detected.

Thus, the monitoring method provides the advantage that if the user fails to notice notification sent to the outside of the monitor area or the user terminal, entry of the user into the monitor area can be reliably hindered and therefore an accident can be avoided wherein the user carelessly enters the monitor area without being aware of the danger in the monitor area and suffers some injury.

The monitoring method according to an embodiment of the invention may further include a communication step of sending notification concerning the anomaly to the user terminal, e.g., the terminal of the user, upon detection of the anomaly in the monitor area, and receiving acknowledgement of the notification from the user terminal, wherein if the acknowledgement of the notification is received in the communication step, the door open control step releases hindering of opening the door.

Thus, the monitoring method provides the advantage that if the user fails to notice the notification received at the user terminal, the user can be made aware of the presence of the notification as he or she cannot enter the monitor area. Therefore the user can be informed of the anomaly in the monitor area with high accuracy.

Thus, the monitoring method provides the advantage that the user can enter the monitor area only if he or she sends the acknowledgement of the notification from the user terminal and therefore the user can always be made aware of the anomaly in the monitor area before entering the monitor area.

In the monitoring method according to an embodiment of the invention, the communication step may send information indicating occurrence of the anomaly to the user terminal and receive acknowledgement of the occurrence of the anomaly from the user terminal, and upon reception of the acknowledgement, may send the contents of the anomaly to the user terminal.

Thus, the monitoring method provides the advantage that the user needs to send acknowledgement of the occurrence of the anomaly from the user terminal to be made aware of the contents of the anomaly and grasp the anomaly. Therefore the user can be prevented from forgetting about sending the acknowledgement from the user terminal.

In a monitoring method according to an embodiment of the invention, if the anomaly in the monitor area is detected, the user approaching the monitor area is detected, and the acknowledgement of the notification is not received in the communication step, the door open control step may hinder opening of the door.

Thus, the monitoring method provides the advantage that the hindering processing of opening the door is performed only while there is a possibility that the user may enter the monitor area and the user does not acknowledge the notification at the user terminal, and therefore efficient processing can be performed.

The monitoring system according to an embodiment of the invention is a monitoring system for monitoring one monitor area, including an anomaly detection section for detecting an anomaly in the monitor area; a door open hindrance section for hindering opening of a door placed at an entrance to the monitor area; and an open hindrance control section for controlling the door open hindrance section so as to hinder opening of the door if the anomaly detection section detects an anomaly.

Thus, the monitoring system provides the advantage that if the user fails to notice notification sent to the outside of the monitor area or the user terminal, entry of the user into the monitor area can be hindered reliably and therefore an accident can be avoided wherein the user enters the monitor area carelessly without being aware of the danger in the monitor area and suffers some injury.

The monitoring system according to an embodiment of the invention may further include a communication section for communicating with the user terminal, the terminal of the user; and a communication control section for controlling the communication section so as to transmit notification concerning the anomaly detected by the anomaly detection section to the user terminal and receive acknowledgement of the notification from the user terminal, wherein if the communication section receives the acknowledgement of the notification, the open hindrance control section controls the door open hindrance section so as to release hindering of opening the door.

Thus, the monitoring system provides the advantage that if the user fails to notice the notification received at the user terminal, the user can be made aware of the presence of the notification as he or she cannot enter the monitor area and therefore the user can be informed of the anomaly in the monitor area with high accuracy.

Thus, the monitoring system provides the advantage that the user can enter the monitor area only if he or she transmits the acknowledgement of the notification from the user terminal and therefore, the user can always be made aware of the anomaly in the monitor area before entering the monitor area.

In the monitoring system according to an embodiment of the invention, the communication control section may control the communication section so as to transmit information indicating the occurrence of the anomaly to the user terminal and receive acknowledgement of the occurrence of the anomaly from the user terminal and upon reception of the acknowledgement, transmit the contents of the anomaly to the user terminal.

Thus, the monitoring system provides the advantage that the user needs to transmit acknowledgement of the occurrence of the anomaly from the user terminal to be made aware of the contents of the anomaly and grasp the anomaly and therefore the user can be prevented from forgetting about transmitting the acknowledgement from the user terminal.

The monitoring system according to an embodiment of the invention may further include an approach detection section for detecting the user approaching the monitor area, wherein if the anomaly detection section detects an anomaly, the approach detection section detects the user approaching the monitor area, and the communication section does not receive the acknowledgement of the notification, the open hindrance control section controls the door open hindrance section so as to hinder opening of the door.

Thus, the monitoring system provides the advantage that the hindering operation of opening the door is performed only while there is a possibility that the user may enter the monitor area and the user does not acknowledge the notification at the user terminal, and therefore efficient operation can be performed.

A computer can be caused to execute the steps of the monitoring method as a monitoring program. Further, the monitoring program may be stored on a computer-readable record medium, whereby the monitoring method can be executed on any desired computer.

What is claimed is:

1. A monitoring system for monitoring a monitor area, comprising:

an anomaly detection section for detecting an anomaly in the monitor area;

a door open hindrance section for hindering the opening of a door positioned at an entrance to the monitor area;

an open hindrance control section for controlling said door open hindrance section so as to hinder opening of the door if said anomaly detection section detects an anomaly;

a communication section for communicating with a user terminal of a user; and a communication control section for controlling the communication section so as to transmit notification concerning the anomaly detected by said anomaly detection section to the user terminal, and to receive acknowledgement of the notification from the user terminal, and wherein if the communication section receives the acknowledgement of the notification, said open hindrance control section controls said door open hindrance section so as to release hindering of opening of the door.

2. The monitoring system as claimed in claim 1, wherein the communication control section is configured to control the communication section so as to transmit information indicating occurrence of the anomaly to the user terminal and to receive acknowledgement of occurrence of the anomaly from the user terminal, and upon reception of the acknowledgement of occurrence, to transmit the contents of the anomaly to the user terminal.

3. The monitoring system as claimed in claim 1, further comprising:

an approach detection section for detecting the user approaching the monitor area, wherein if (1) said anomaly detection section detects an anomaly, (2) the approach detection section detects the user approaching the monitor area, and (3) the communication section does not receive the acknowledgement of the notification, said open hindrance control section controls said door open hindrance section so as to hinder opening of the door.

4. A method of monitoring a monitor area, comprising:

hindering the opening of a door positioned at an entrance to the monitor area based in part upon the detection of an anomaly in the monitor area;

sending notification concerning the anomaly to a user terminal of a user upon detection of the anomaly in the monitor area;

receiving acknowledgement of the notification from the user terminal; and releasing the hindering of the opening the door upon receiving the acknowledgement of the notification.

5. The method as claimed in claim 4, further comprising:

sending information indicating an occurrence of the anomaly to the user terminal;

receiving acknowledgement of the occurrence of the anomaly from the user terminal; and sending the contents of the anomaly to the user terminal upon receiving the acknowledgement of the occurrence of the anomaly.

6. The method as claimed in claim 4, wherein the hindering the opening of the door step comprises:

hindering the opening of the door step when (1) the anomaly in the monitor area is detected, (2) the user approaching the monitor area is detected, and (3) the acknowledgement of the notification is not received.

7. A monitoring method of monitoring one monitor area, comprising:

a door open control step of hindering opening of a door placed at an entrance to the monitor area if an anomaly in the monitor area is detected;

a communication step of sending notification concerning the anomaly to a user terminal upon detection of the anomaly in the monitor area and receiving acknowledgement of the notification from the user terminal, wherein if the acknowledgement of the notification is received in the communication step, said door open control step releases hindering of opening the door.

8. The monitoring method as claimed in claim 7, wherein the communication step sends information indicating occurrence of the anomaly to the user terminal and receives acknowledgement of occurrence of the anomaly from the user terminal and upon reception of the acknowledgement, sends the contents of the anomaly to the user terminal.

9. The monitoring method as claimed in claim 7, wherein if the anomaly in the monitor area is detected, the user approaching the monitor area is detected, and the acknowledgement of the notification is not received in the communication step, said door open control step hinders opening of the door.

10. A computer-readable record medium recording a computer program, the computer program for causing when executed, a computer to perform a method of monitoring a monitor area, the method comprising:

hindering the opening of a door positioned at an entrance to the monitor area based in part upon the detection of an anomaly in the monitor area;

sending notification concerning the anomaly to a user terminal of a user upon detection of the anomaly in the monitor area;

receiving acknowledgement of the notification from the user terminal; and releasing the hindering of the opening the door upon receiving the acknowledgement of the notification.

11. The computer-readable record medium as claimed in claim 10, the method further comprising:

sending information indicating an occurrence of the anomaly to the user terminal;

receiving acknowledgement of the occurrence of the anomaly from the user terminal; and sending the contents of the anomaly to the user terminal upon receiving the acknowledgement of the occurrence of the anomaly.

12. The computer-readable record medium as claimed in claim 10, wherein the hindering the opening of the door step comprises:

hindering the opening of the door step when (1) the anomaly in the monitor area is detected, (2) the user approaching the monitor area is detected, and (3) the acknowledgement of the notification is not received.

* * * * *